US009493015B2

(12) United States Patent
Monclus Velasco et al.

(10) Patent No.: US 9,493,015 B2
(45) **Date of Patent: *Nov. 15, 2016**

(54) PRINTING APPARATUS AND METHODS

(71) Applicant: Hewlett-Packard Development Company, L.P., Houston, TX (US)

(72) Inventors: Antonio Monclus Velasco, Castelldefels (ES); David Claramunt Morera, Sant Esteve Sesrovires (ES); Raimon Castells De Monet, Barcelona (ES); Francisco Javier Perez Gellida, Sant Cugat (ES); Xavier Soler Pedemonte, Barcelona (ES); Jesus Garcia Maza, Terrassa Barcelona (ES); Roger Bastardas Puigoriol, Sant Just Desvern (ES); Mikel Zuza Irurueta, Barcelona (ES); Elena Laso Plaza, Barcelona (ES); Francisco Javier Rodriguez Escanuela, Mataro (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 47 days.

This patent is subject to a terminal disclaimer.

(21) Appl. No.: 14/546,348

(22) Filed: Nov. 18, 2014

(65) Prior Publication Data

US 2015/0070453 A1 Mar. 12, 2015

Related U.S. Application Data

(63) Continuation of application No. 13/483,513, filed on May 30, 2012, now Pat. No. 8,967,786.

(51) Int. Cl.
*B41J 11/00* (2006.01)

(52) U.S. Cl.
CPC ..... *B41J 11/0015* (2013.01); *B41J 11/002* (2013.01)

(58) Field of Classification Search
CPC ..... B41J 11/002; B41J 11/0015
USPC ..... 347/102
See application file for complete search history.

(56) References Cited

U.S. PATENT DOCUMENTS

| | | | | |
|---|---|---|---|---|
| 5,633,668 | A | 5/1997 | Schwiebert et al. | |
| 5,966,836 | A | 10/1999 | Valdez, III et al. | |
| 6,463,674 | B1 * | 10/2002 | Meyers | B41J 11/002 34/304 |
| 6,505,419 | B2 | 1/2003 | Poetter | |
| 7,505,722 | B2 | 3/2009 | Condello et al. | |
| 2003/0156177 | A1 * | 8/2003 | Nishikawa et al. | 347/102 |
| 2004/0041893 | A1 * | 3/2004 | Hoshino | 347/102 |
| 2004/0189769 | A1 * | 9/2004 | Wilbur et al. | 347/102 |
| 2009/0079795 | A1 * | 3/2009 | Motoharu | B41J 11/06 347/56 |
| 2009/0185841 | A1 | 7/2009 | Izawa et al. | |
| 2009/0322811 | A1 * | 12/2009 | Higgins et al. | 347/9 |
| 2011/0267410 | A1 * | 11/2011 | Yamamoto | B41J 11/002 347/102 |
| 2012/0120149 | A1 * | 5/2012 | Hladik et al. | 347/20 |

FOREIGN PATENT DOCUMENTS

JP 2007276309 10/2007

* cited by examiner

*Primary Examiner* — Stephen Meier
*Assistant Examiner* — Alexander D Shenderov
(74) *Attorney, Agent, or Firm* — Fabian Van Cott

(57) ABSTRACT

Methods for curing ink printed on a print medium are disclosed. The methods comprise heating air to a temperature suitable for curing the ink, and blowing the air through a plurality of holes onto the print medium.

18 Claims, 4 Drawing Sheets

PRINTING APPARATUS AND METHODS

CROSS REFERENCE TO RELATED APPLICATIONS

This application is a continuation application of and claims the benefit of co-pending U.S. patent application Ser. No. 13/483,513 filed on May 30, 2012 entitled "Printing Apparatus and Methods" by Velasco et al., and assigned to the assignee of the present application.

DESCRIPTION OF EMBODIMENTS

Figure 1:
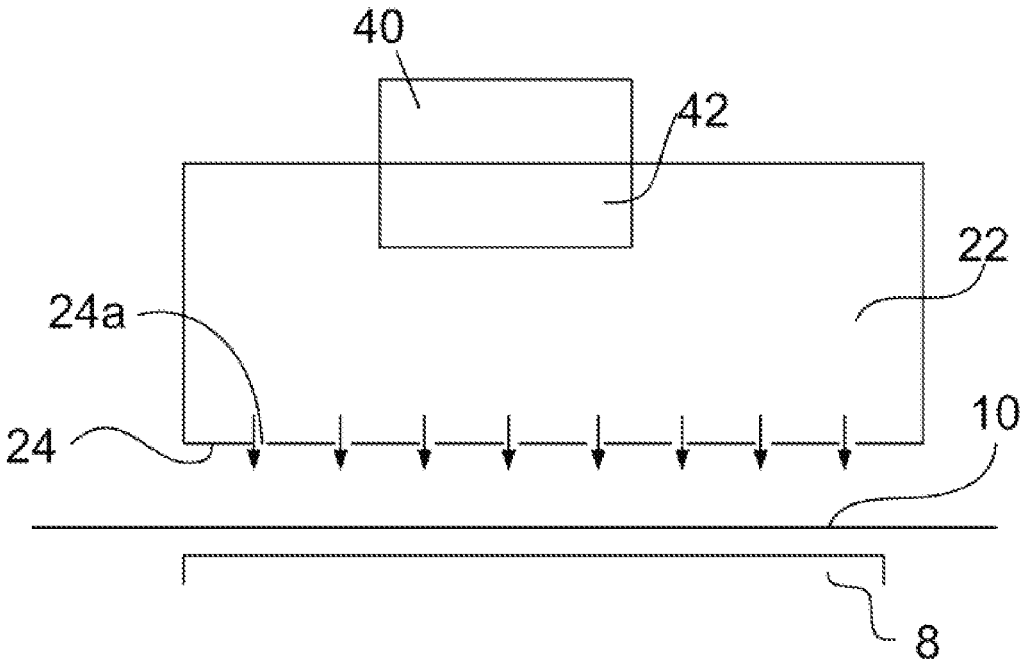
FIG. 1 schematically illustrates an example of an impingement module which may be arranged in a printing apparatus.

A printer is generally used for (re)producing text and images. Throughout this application, when reference is made to an image or images, this is to be interpreted as also explicitly referring to text (not only figures).

Different types of printers are known, amongst which laser printers, thermal printers, dot matrix printers and inkjet printers.

Inkjet printers use at least one printhead provided with a plurality of nozzles, from which ink droplets are fired or ejected onto the media (or fluid in the case of pre/post treatments); the printer controls the firing of ink from the nozzles such as to create on the media a pattern of dots corresponding to the desired image. Different types of ink may be used.

The printhead may be fixed and extend along the entire width of the print medium. Alternatively, a scanning printhead moving along a scan axis, which may be generally perpendicular to the movement of the print medium, may be used to print along the entire width of the print medium.

The print medium may e.g. be separate sheets of paper. Particularly in large format printers, the print medium may be a continuous web, which is fed from a feed roll mounted on a spindle arranged in the printing apparatus upstream of the printhead and on which several different plots are printed one after the other. A motor may be operatively connected to said spindle to drive the spindle with appropriate speed when printing.

Depending on the type of ink used, the ink may need to be actively dried and/or cured after being printed on the print medium. For example, latex ink may generally be used to increase the durability of plots. In apparatus using latex ink, the ink is to be dried and cured, optionally in two separate stages. Latex ink is a stable dispersion (emulsion) of polymer microparticles in an aqueous medium. Latexes may be natural or synthetic. Preferably, before the print medium exits the printing apparatus, the ink has been completely dried and cured, such that no external dryer is needed, and the printed medium is ready for use or shipment and can be stored without problems.

Drying of the ink requires evaporation of water present in the ink. This may be achieved by heating air and passing air along the print medium in the area of the print zone, or downstream thereof.

Curing herein may be understood as hardening of the polymers in the ink which leads to the formation of a continuous film. Curing generally requires higher temperatures, such that the continuous film may be formed and a chemical bond is formed with the print medium. Some of the co-solvents of the ink may evaporate only at the curing stage.

In some known applications, an infrared heater is used for heating up a print medium and air is passed along the print medium in a manner generally parallel thereto. The temperature to which the print medium needs to be heated may be high, and the curing process may thus require a lot of energy. The high temperature may be needed for removing particular solvents, such as e.g. methyl-propanediol (MP-Diol) and 2-Pyrrolidone (2P) solvents. These high temperatures may also limit the range of print media that can be used. Additionally, the curing may not be uniform along the width of the print medium, so that the latex film formation is not homogeneous.

In systems and methods according to the present invention, at least some of the above-mentioned problems can be resolved or reduced.

Figure 2A:
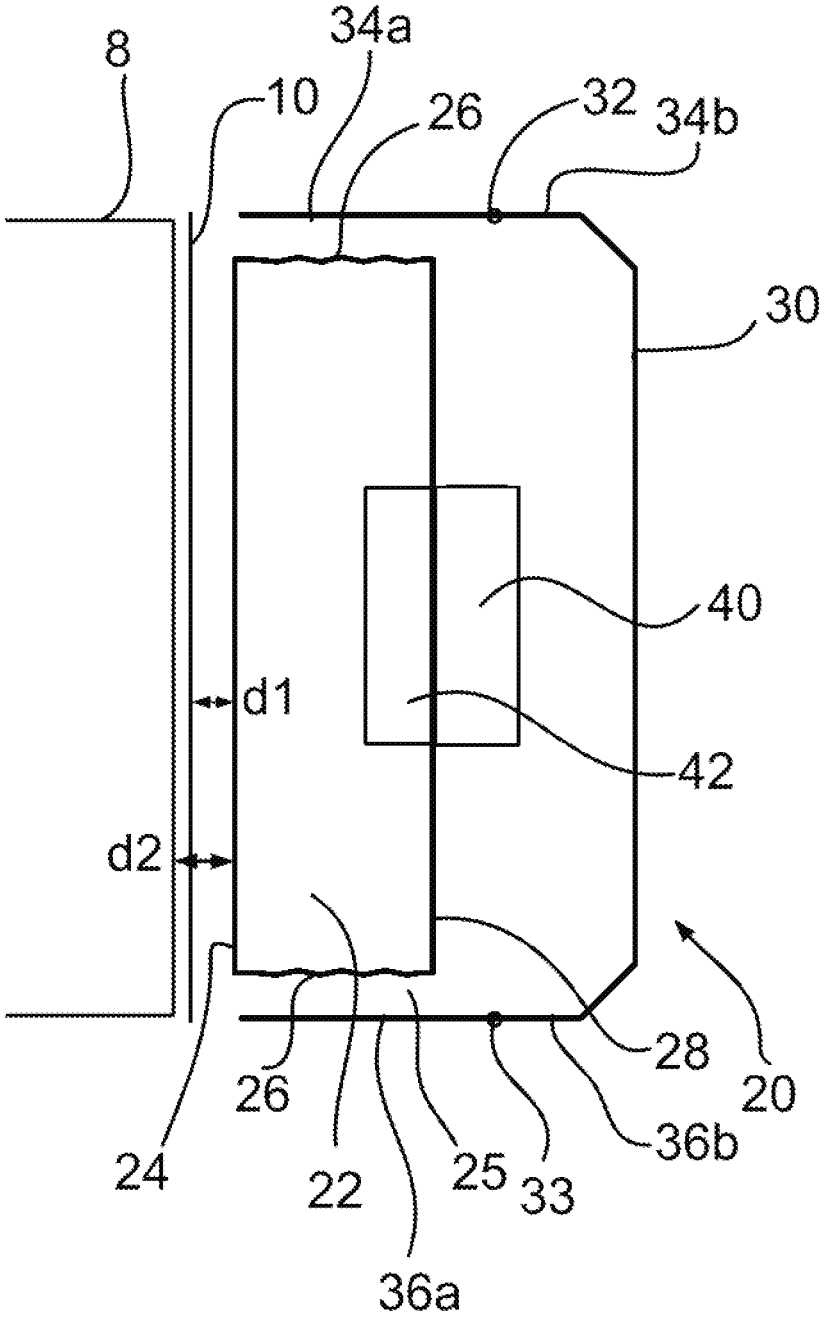
FIGS. 2*a* and 2*b* schematically illustrate another example of an impingement module 20.
Figure 2B:
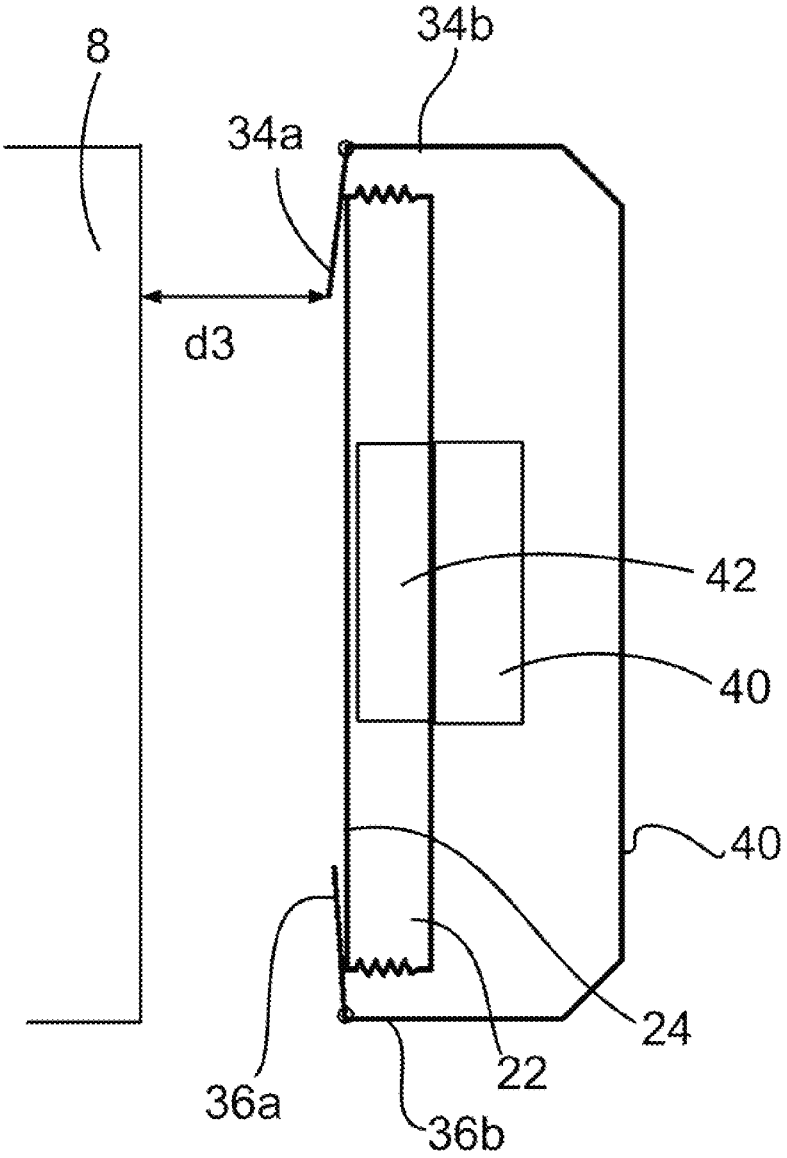
Figure 3:
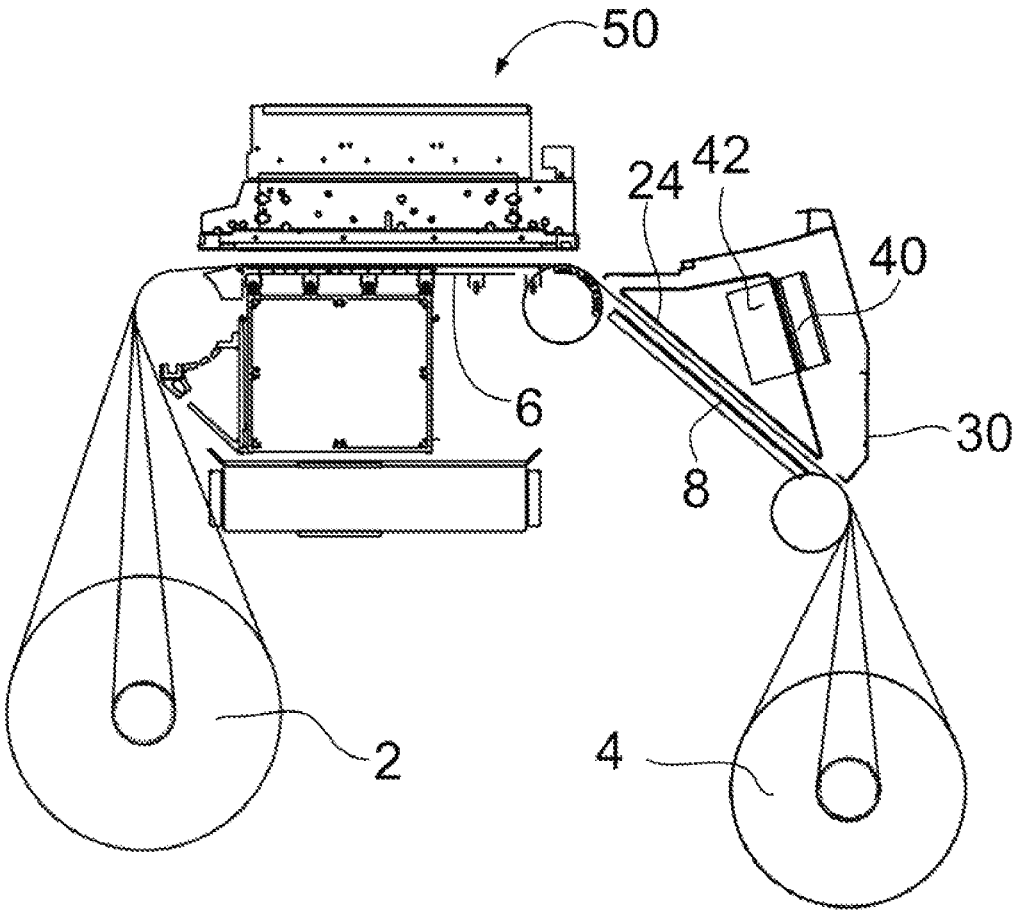
FIG. 3 schematically illustrates a printing apparatus according an example.

Particular embodiments of the present invention will be described in the following by way of non-limiting examples, with reference to the appended drawings, in which:

FIG. 1 schematically illustrates an example of an impingement module;

FIGS. 2*a* and 2*b* schematically illustrate another example of an impingement module; and FIG. 3 illustrates a further example of a printing apparatus.

FIG. 1 schematically illustrates an example of an impingement module which may be arranged in a printing apparatus. The impingement module may IC be arranged in or downstream from a print zone. A print medium 10 may have image or text printed on it. The print medium moves along a medium path. In the shown area of the printing apparatus, the print medium 10 may be supported by medium support 8.

The impingement module may comprise a heater 42, and a fan 40. The fan 40 moves the air from outside into the inside of the heating chamber 22. The heater 42 may be a coil heater and may heat the air inside the chamber 22 to a suitable temperature.

The bottom of the heating chamber 22 is formed by an impingement plate 24 having a plurality of holes 24*a*. The fan 40 forces the heated air through the holes 24*a* and jets of hot air impinge on the print medium 10. Ink printed on a print medium may be dried and/or cured by the hot air impinged on the print medium. In the illustrated case, the air impinges on the print medium 10 in a perpendicular manner.

Depending on the printing apparatus, the impingement module may be used for curing ink, such as e.g. inks comprising polymer resins dispersed in water or in another solvent. An example may be an ink comprising polyurethane resin dispersed in water.

Another example may be to cure a latex ink, such as e.g. a PMMA latex based ink. To this end, air may be heated to a temperature suitable for curing the latex ink. The fan(s) may blow the heated air on the medium through the plurality of holes in the impingement plate. The hot air jets impinging on the print medium may be at a temperature of e.g. between 80-120° C. At these temperatures, a latex film may be formed and co-solvents of the latex, such as e.g. MP-Diol and 2P solvents may evaporate. The temperature of the air may depend on the print medium used and also on the velocity of the print medium through the print zone.

Compared to prior art curing modules based on infrared heating and parallel airflow, the mass and heat transfer coefficients may improve when using impingement. Since these transfer coefficients are better, the temperature required for curing may be relatively low. This may increase the range of print media that can be used. For example, synthetic media and media like aluminium sheet, which cannot be used in systems incorporating curing based on infrared heating because of the high temperatures, may be usable in systems based on impingement.

The use of a heating chamber ensures that the air impinging on the print medium is of a relatively uniform temperature. A generally uniform temperature of the air leads to more even and homogeneous curing.

In some implementations, an impingement module may be used for both drying and curing. In other implementations, separate systems for drying and curing may be employed.

Depending on the requirements of the printing apparatus and the ink density of the plot, the impingement air velocity and temperature, and print medium velocity through the print zone may be varied. A lower print medium velocity means that more air is impinged on each portion of the print medium. A higher impingement air velocity may remove more moisture from the ink. On the other hand, the air velocity should not be so high that the ink printed on the print medium is moved producing inaccuracies in the plot. Also, a high velocity may increase the power consumption of an impingement module. A higher temperature may increase the heat transfer, but requires more power.

The number of holes, their size, orientation with respect to the print medium and their distribution along the width and length of the impingement plate may be varied. Generally, the distribution of holes, their size, orientation and their number may be optimized with respect to homogeneous curing (and/or drying).

FIGS. 2*a* and 2*b* schematically illustrate another example of an impingement module 20. A print medium 10 moves along a medium path and is supported by a media support 8. The impingement module 20 may comprise an inner heating chamber 22. The heating chamber 22 may be formed by an impingement plate 24 having a plurality of holes, a top wall 28 and sidewalls 26. The sidewalls 26 may at least be partially flexible.

The impingement module may further comprise one or more heaters 42 and one or more fans 40. The fans may force the air that is heated in the heating chamber through the holes of the impingement plate onto the print medium. Ink printed on the print medium may be dried and/or cured by the air impinging on it.

In some implementations, the impingement module 20 may further comprise an outer cover 30 covering heating chamber 22. The heater and fan may thus be shielded from users.

Also, a recirculation path 25 may be formed between the outer cover 30 and the heating chamber 22 so that a pad of the air that impinged on the print medium may be recirculated towards the fan. The recirculation of heated up air may reduce the energy consumption required for curing and/or drying. The amount of air that is recirculated depends among others on the space between the print medium and the cover at the edges of the print medium. In other implementations, a recirculation path may not be foreseen.

For efficient impingement, the distance d1 between the impingement plate and the print medium may depend on the pattern of holes in the impingement plate, but this distance should generally be relatively small. The distance d2 between the lowest point of the impingement module (in the illustrated case, the impingement plate) and the medium support 8 is closely related to said distance d1 and determines the space available for threading of the print medium. Particularly in the case of wide media, threading may be complicated if there is only a small gap between the lowest point of the impingement module and the media support 8.

In one example, at least part of the sidewalls of the heating chamber may be flexible such that the heating chamber is partly collapsible. When a pressure is exerted on the bottom of the impingement plate, the length of the wall, and thereby the height of the heating chamber may be reduced.

In the example illustrated in FIGS. 2*a* and 2*b*, when one pushes against the bottom of the impingement plate, consecutive portions of the sidewall may be folded on top of each other, thus reducing the length of the wall and the height of the heating chamber.

Side covers may extend generally parallel to the sidewalls of the heating chamber. The side covers may comprise top portions 34*b* and 36*b* and bottom portions 34*a* and 36*a* that are hingedly connected to the top portions.

With reference to FIG. 2*b*, an operator may push on the impingement plate, such as to collapse the heating chamber for threading of the print medium. Additionally, the bottom wall portions 34*a* and 36*a* may be folded inwards. As a result, the distance d3 between the medium support 8 and the impingement module is increased compared to the situation of FIG. 2*a*. Threading of the print medium may be much easier in this situation. The example of the impingement module illustrated in FIGS. 2*a* and 2*b* thus combines energy efficiency, due to the air recirculation and the efficient impingement thanks to the small distance between the impingement plate and the print medium, and user-friendliness as it allows for easy threading without having to remove the impingement module.

In alternative examples, an impingement module may be movable along a plurality of guides, the guides extending in a direction substantially perpendicular to the print medium. In operation, the impingement module may be arranged close to the print medium. For threading of the print medium, the impingement module may then be moved along the guides away from the print medium.

FIG. 3 schematically illustrates a printing apparatus according to another example. A print medium may be fed from an input roll 2, and pass along a print zone 50, in which a plot is made on the print medium supported by the platen 6. An inkjet printhead may be used for printing, and the ink may be an ink that requires drying and curing.

The print medium may be collected on an output roll 4. Along the path of the print medium, various passive redirecting rollers and one or more drive rollers (driven by a motor to determine the speed of the print medium) may be arranged.

The printing apparatus according to this example may comprise a separate drying module and a separate curing module. The drying module may be based on infrared radiation heating and may incorporate two infrared lamps arranged parallel to each other along the print medium axis. One or more fans may be used to establish a flow of hot air generally parallel to the medium path. In alternative implementations, the drying module is not necessary split in separate portions.

The curing module 20 may be arranged downstream from the drying module and may comprise a heater 42 for heating up air. The heater may be e.g. a coil heater. A fan 40 may establish a flow of hot air through holes of the impingement plate 24. The print medium may be locally supported by medium support 8.

The curing module may comprise an outer cover 30, such that an air recirculation path may be established between the outer wall of the heating chamber and the inside of the outer cover 30. At least part of the air that has been blown on the print medium may be recirculated.

Since a separate drying module is provided, the air impinging on the print medium in the zone of the curing module will contain relatively little water. The water from the ink may have been evaporated mostly by the drying module. A high rate of recirculation may thus be employed without difficulties. This may further increase the energy efficiency of the printing apparatus.

A separation of drying and curing may be employed in printing apparatus of high performance, e.g. high throughput.

Although only a number of particular embodiments and examples of the invention have been disclosed herein, it will be understood by those skilled in the art that other alternative embodiments and/or uses of the invention and obvious modifications and equivalents thereof are possible. Furthermore, the present invention covers all possible combinations of the particular embodiments described. Thus, the scope of the present invention should not be limited by particular embodiments, but should be determined only by a fair reading of the claims that follow.

What we claim is:

1. A printing apparatus comprising a conveyance system to convey a print medium through the apparatus in a conveyance direction, a drying system to dry ink printed on the print medium and a separate curing system to cure ink printed on the print medium, wherein the curing system is arranged downstream from the drying system in the conveyance direction and the curing system comprises:

a heater to heat air to a temperature suitable for curing the ink;

an impingement plate having a plurality of holes; and a fan for blowing the heated air through the plurality of holes onto the print medium such that said ink deposited upon said surface is cured.

2. A printing apparatus according to claim 1, wherein the curing system further comprises:

an air recirculation path for recirculating air blown onto the medium back to the heater.

3. A printing apparatus according to claim 1, wherein the curing system further comprises:

a heating chamber, and wherein the heater is provided in the heating chamber.

4. The printing apparatus according to claim 3, further comprising foldable wall portions that selectively fold inward to hold the heating chamber in a state in which the heating chamber is at least partially collapsed to facilitate threading of print media into a print zone.

5. A printing apparatus according to claim 1, wherein the heater is a coil heater.

6. A printing apparatus according to claim 1, wherein the curing system is movable along a plurality of guides, the guides extending in a direction substantially perpendicular to the print medium.

7. A printing apparatus according to claim 1, wherein the ink is latex ink.

8. A printing apparatus according to claim 1, wherein the holes, of the plurality of holes, are evenly spaced on the impingement plate to evenly heat and cure said deposited ink.

9. A printing apparatus according to claim 1, the impingement plate is arranged such that the heated air is delivered through the plurality of holes in a direction perpendicular to a surface of the print medium.

10. A printing apparatus according to claim 1, wherein the heater heats the air to between 80-120° C.

11. A method for curing ink printed on a print medium, the method comprising:

heating air to a temperature suitable for curing the ink; and blowing air through a plurality of holes in an impingement plate disposed at a print zone onto the print medium in a manner perpendicular to the print medium such that said ink deposited upon said surface is cured.

12. A method according to claim 11, wherein the print medium is a metal sheet medium.

13. A method according to claim 12, wherein the print medium is made of aluminium sheet metal.

14. A method according to claim 11, wherein the air is heated in a heating chamber.

15. A method according to claim 14, further comprising:

recirculating at least part of the air blown onto the print medium back to the heating chamber.

16. A method according to claim 11, wherein the ink is latex ink.

17. A method according to claim 11, further comprising setting the temperature to which the air is heated based on a type of print medium used.

18. A method according to claim 11, further comprising setting the temperature to which the air is heated based on a velocity of the print medium through a print zone.

* * * * *